US006449440B1

(12) United States Patent
Sawada

(10) Patent No.: US 6,449,440 B1
(45) Date of Patent: Sep. 10, 2002

(54) IMAGE FORMING SYSTEM HAVING JOB RECOVERY DEPENDING ON NUMBER OF SHEETS IN EJECTION TRAY

(75) Inventor: Shigeru Sawada, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 33 days.

(21) Appl. No.: 09/599,029

(22) Filed: Jun. 22, 2000

(30) Foreign Application Priority Data

Jul. 8, 1999 (JP) ..... 11-194980

(51) Int. Cl.[7] ..... G03G 15/00
(52) U.S. Cl. ..... 399/19; 399/21
(58) Field of Search ..... 399/19, 21, 43, 399/79, 405, 407–409, 410

(56) References Cited

U.S. PATENT DOCUMENTS 4,163,897 A * 8/1979 Hubbard et al. ..... 377/8
4,341,462 A * 7/1982 Ogura ..... 399/21
4,449,813 A * 5/1984 Kikuchi et al. ..... 399/19
4,511,241 A * 4/1985 Tsudaka et al. ..... 399/19
4,521,102 A * 6/1985 Motomura et al. ..... 399/19
5,836,578 A 11/1998 Hirano et al.
5,839,014 A * 11/1998 Takahashi et al. ..... 399/21
5,944,645 A 8/1999 Kobayashi

FOREIGN PATENT DOCUMENTS

JP 63-147776 * 6/1988
JP 05-323753 * 12/1993

* cited by examiner

*Primary Examiner*—Robert Beatty
(74) *Attorney, Agent, or Firm*—Morrison & Foerster LLP

(57) ABSTRACT

The system monitors the number of sheets that should be housed in the finishing tray based on the information from the copying machine, the output from the sensor located on the sheet conveyance path to the finishing tray unit and the signals that indicate ejection of the sheets from the finishing tray. When jam correction is performed, the system determines the number of sheets for which image formation should be re-performed in accordance with the output from the finishing tray paper detection sensor.

11 Claims, 6 Drawing Sheets

IMAGE FORMING SYSTEM HAVING JOB RECOVERY DEPENDING ON NUMBER OF SHEETS IN EJECTION TRAY

RELATED APPLICATION

This application is based on application No. H11-194980 filed in Japan, the entire content of which is hereby incorporated by reference.

BACKGROUND OF THE INVENTION

1. Field of the Invention

The present invention pertains to an image forming system comprising an image forming apparatus that, when a paper jam occurs in the original document or recording sheet conveying system and the problem is eliminated, re-forms the images that were not properly formed due to the paper jam, and to a finisher that performs finishing processes on the recording sheets ejected from the image forming apparatus.

2. Description of the Related Art

In recent years, in response to increasing user demand, manufacturers of image forming apparatuses such as copying machines and printers have gone beyond simply forming and outputting images on recording sheets, and are often providing, as optional devices to be attached to the image forming apparatuses, devices (hereinafter collectively termed 'finishers') that perform finishing processes to the recording sheets, such as folding of the sheets on which images have been formed into two parts or three parts (z-folding) (hereinafter termed the 'paper folding process'), the punching of holes at prescribed locations on the sheets (hereinafter termed the 'punching process') or the binding of the sheets using staples (hereinafter termed the 'stapling process').

In these finishers, in order to perform stapling, for example, the sheets that were sequentially ejected from the image forming apparatus must be stacked, and after a prescribed number of sheets have been stacked, stapling must be performed. Therefore, the finisher is often equipped with a stacking means such as a finishing tray on which sheets that have undergone image formation are stacked.

On the other hand, many recent image forming apparatuses include a function that performs jam correction when a paper jam (hereinafter simply termed 'jam') involving the recording sheets on which images are formed occurs in the conveyance system. Here, jam correction refers to the function in which image formation is performed anew for the images which were not properly formed due to the occurrence of the jam, using the image data stored in the image memory.

In this jam correction, the effect of the jam is compensated for and consequently all of the images are formed by counting the number of pages of the original document for which image formation should be performed and the number of pages for which image formation has been properly completed, and when a paper jam is eliminated, image formation is performed anew for those pages of the original document for which image formation has not yet been properly completed.

In a conventional image forming system comprising an image forming apparatus having the jam correction function described above and a conventional finisher, even if a jam occurs in the image forming apparatus, no special processes take place in the finisher. In addition, regarding the recording sheets that have been ejected to the finisher, the image forming apparatus simply assumes that image formation has properly been performed on them and that they have been ejected.

However, when a jam occurs in the image forming apparatus of a conventional image forming system, when the user tries to eliminate the problem, there are cases in which the user removes the sheets that are remaining on the stacking means, such as a finishing tray, inside the finisher. In such a case, in a conventional image forming system, image formation is not performed again for the images that were already formed on the sheets removed from the stacking means, and as a result, the problem occurs that the bundle of stapled sheets has missing pages.

SUMMARY OF THE INVENTION

The object of the present invention is to resolve the problem described above.

Another object of the present invention is to provide an image forming system in which the bundle of sheets on which images have been formed, does not have missing pages even when the user removes the recording sheets remaining on the stacking means in order to carry out jam correction.

These and other objects of the present invention are attained by an image forming apparatus comprising: an image forming unit for receiving a job comprising multiple pages and sequentially performing image formation; a tray for receiving sheets on which images have been formed by the image forming unit; a counter that counts the number of sheets received by the tray; a first controller that, when a jam occurs in the image forming unit during the job and image formation is subsequently restarted, if sheets are remaining on the tray, restarts image formation with the page corresponding to the count value of the counter; and a second controller that, when a jam occurs in the image forming unit during the job and image formation is subsequently restarted, if sheets are not remaining on the tray, restarts image formation with the first page regardless of the count value.

These and other objects of the present invention are also attained by an image forming apparatus comprising: an image forming unit for forming images on sheets by performing multiple image forming operations; a first counter for counting the commencement of the image forming operations; a holder for holding the sheets ejected from the image forming unit; a finisher for performing finishing processes to the sheets stacked on the holder; a second counter for counting the sheets held on the holder; a sensor for detecting whether or not sheets are stacked on the holder; and a controller for controlling the image forming unit so that where the sensor detects that sheets are stacked on the holder after the jam that occurred in the image forming unit is eliminated, the image forming unit restarts image formation for the number or sheets counted by the first counter but not by the second counter, and where the sensor detects that no sheets are stacked on the holder, the image forming unit restarts image formation for the number of sheets counted by the first counter regardless of the count value of the second counter.

These and other objects of the present invention are also attained by an image forming system comprising: a finisher having: a finishing device for performing a finishing process on the bundle of sheets on which images have been formed and that are stacked on the tray; and a removing mechanism for removing from the tray the bundle of sheets that have undergone the finishing process by the finishing device; and an image forming apparatus for re-forming images that were formed on the bundle of sheets removed from the tray by a means other than the removing mechanism.

These and other objects of the present invention are also attained by an image forming system comprising an image forming apparatus having a function in which, when a paper jam occurs in the original document conveyance system or in recording sheet conveyance system and is subsequently eliminated, the images that were not properly formed due to the paper jam are formed again, and a finisher having a tray on which the recording sheets ejected from the image forming apparatus are stacked and for performing a finishing process to the recording sheets, said system comprising: a first counter for counting the number of the original document pages on which an image should be formed by means of the image forming apparatus; a second counter for counting the number of recording sheets stacked on the stacking means; a calculator that, when a paper jam is eliminated, calculates the number of images that should be formed again by subtracting the count value of the second counter from the count value of the first counter; a determining for determining whether or not recording sheets are stacked on the tray before the calculation by means of the calculator takes place; and a controller that, where it is determined by the determining unit that no recording sheets are stacked on the tray, sets the count value of the second counter to zero and prompts the calculation by the calculator.

These and other objects of the present invention are also attained by a finisher having a tray on which the recording sheets ejected from the image forming apparatus are stacked, said finisher also having: a first sensor that detects the stacking of a recording sheet on the tray and generates a signal representing the number of sheets on the tray; and a second sensor that, when a paper jam occurs in the original document or recording sheet conveyance system of the image forming apparatus and is subsequently eliminated, detects whether or not recording sheets are stacked on the tray, and generates a signal representing the detection result.

These and other objects of the present invention are also attained by a finisher comprising: a tray on which the recording sheets ejected from an image forming apparatus are stacked; a first sensor that detects the stacking of a recording sheet on the tray and generates a signal representing the number of sheets on the tray; and a second sensor that, when a paper jam occurs in a original document conveyance system or in a recording sheet conveyance system of the image forming apparatus and is subsequently eliminated, detects whether or not recording sheets are stacked on the tray, and generates a signal representing the detection result.

These and other objects of the present invention are also attained by an image forming system comprising an image forming apparatus having a function by which, when a paper jam occurs in the original document or recording sheet conveyance system and is subsequently eliminated, the images that were not properly formed due to the problem are formed again, as well as a finisher that has a stacking means on which the recording sheets ejected from the image forming apparatus are stacked, wherein, when forming images that were not properly formed due to a paper jam, said image forming apparatus determines the number of images that should be formed again based on the information provided by the finisher regarding the number of images that should be formed again.

These and other objects of the present invention are also attained by an image forming method comprising: a step in which multiple images are sequentially formed by the image forming apparatus on multiple sheets, which are then ejected outside the apparatus; a step in which the sheets ejected from the image forming apparatus are sequentially held on the first holder; a step in which a finishing process is performed to the sheets held on the first holder; a step in which, when a paper jam occurs in the image forming apparatus, it is determined whether or not the sheets are stacked on the first holder; a step in which, when the paper jam is eliminated, the first image of the images to be sequentially formed is determined based on the sensor output; and a step in which image formation is performed again in response to the determination.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawing.

DESCRIPTION OF THE PREFERRED EMBODIMENT

An embodiment of the image forming system of the present invention is explained below with reference to the drawings.

(1) Construction of entire image forming system

Figure 1:
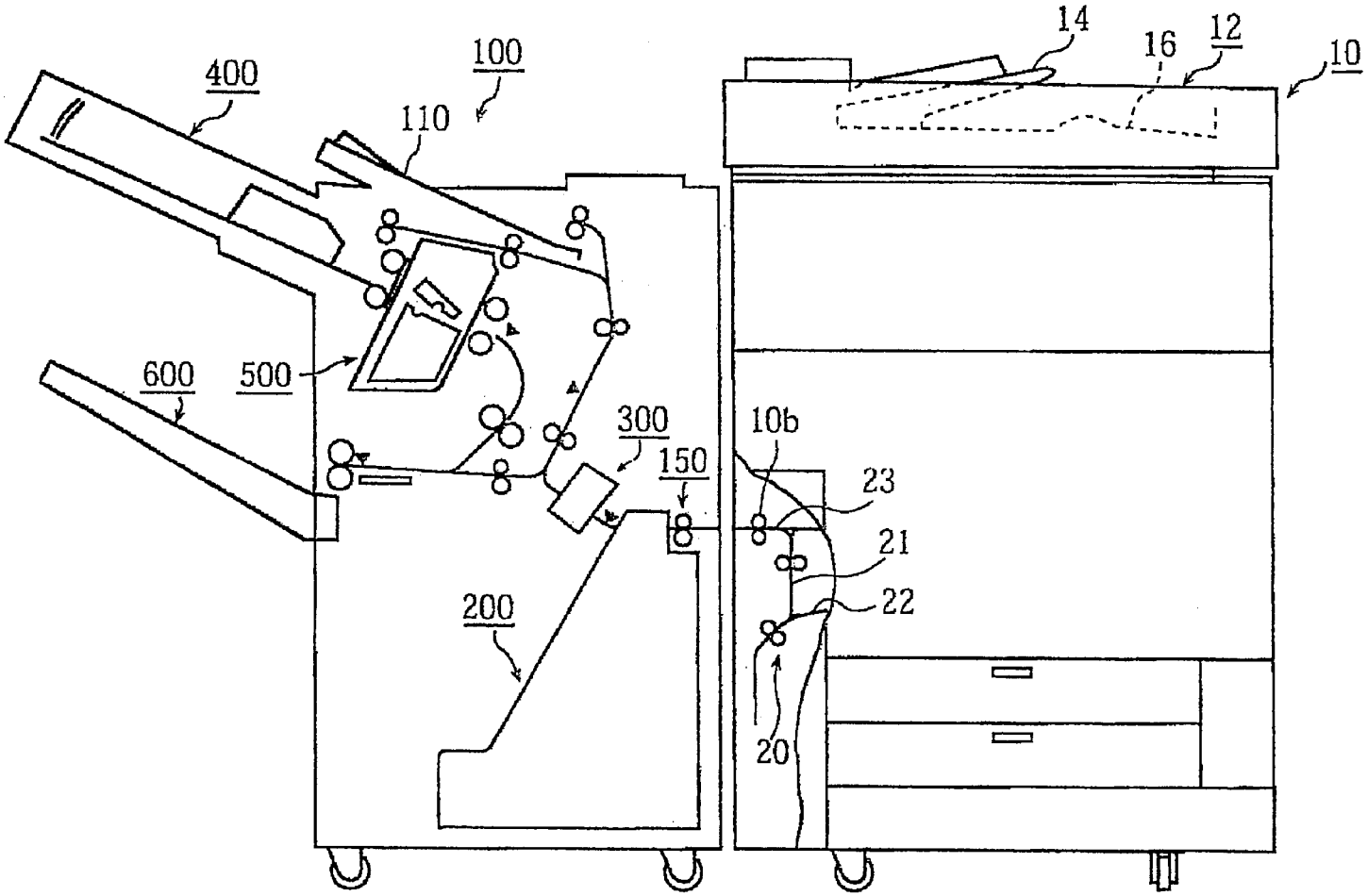
FIG. 1 is a basic cross-sectional view showing the construction of the entire image forming system comprising an embodiment of the present invention.

FIG. 1 is a basic cross-sectional view showing the construction of the entire image forming system comprising an embodiment of the present invention. As shown in this drawing, the image forming system of this embodiment comprises a copying machine 10, which is one example of an image forming apparatus, and a finisher 100 connected to the copying machine 10.

In this specification, the direction in which the sheet is conveyed is termed the 'direction of sheet conveyance' and the direction that is perpendicular to the direction of sheet conveyance is termed the 'direction perpendicular to sheet conveyance'. Using the direction of sheet conveyance as a reference, the orientation of the sheet where the length of the sheet runs along the direction of sheet conveyance is termed 'portrait orientation', and the orientation of the sheet where the length of the sheet runs perpendicular to the direction of sheet conveyance is termed 'landscape orientation'.

(2) Construction of Copying Machine 10

Figure 4:
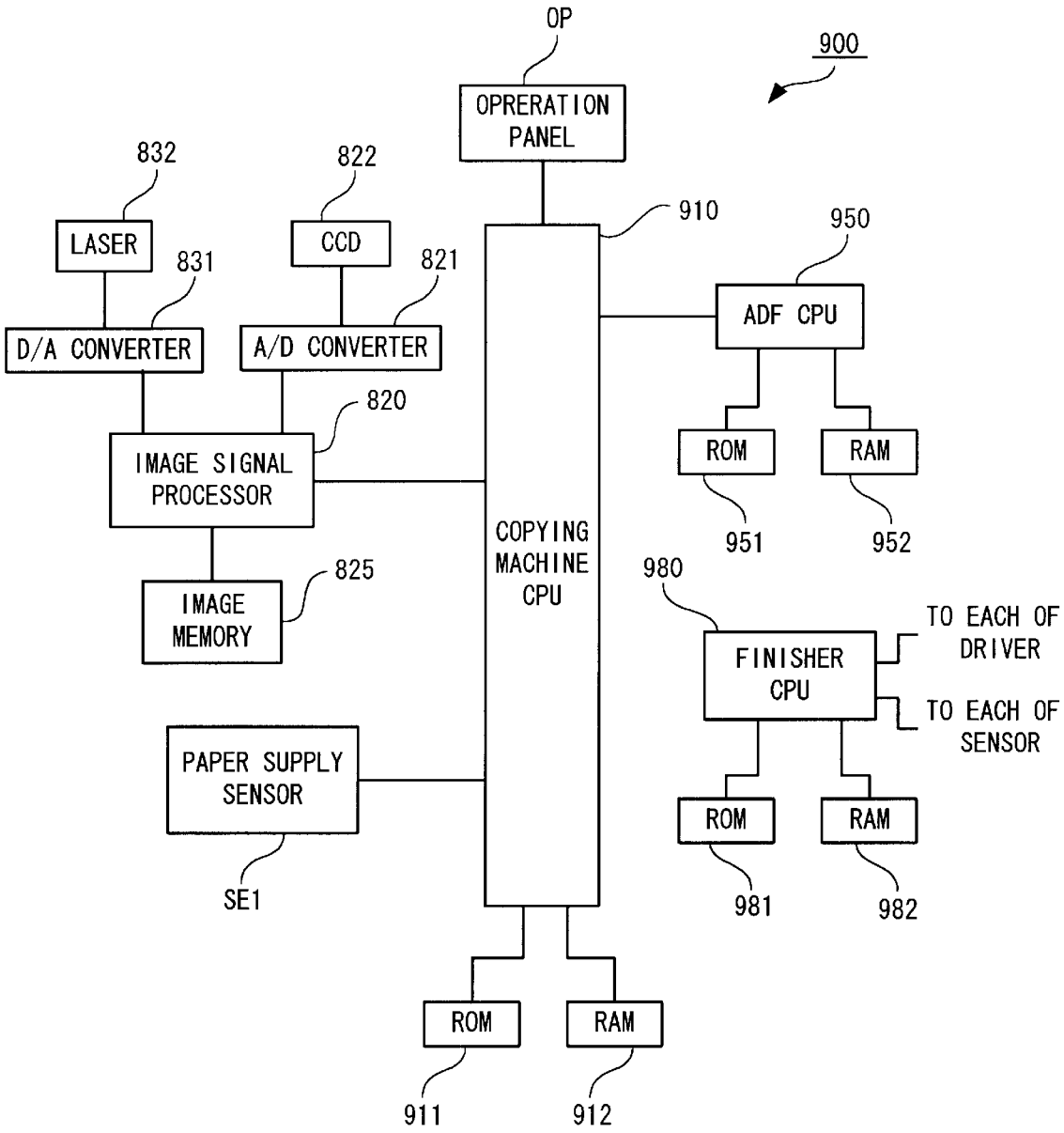
FIG. 4 is a block diagram showing the construction of the control system 900.

The copying machine 10 to which the finisher 100 is connected is a so-called digital copying machine that reads the images on the original document pages and stores them in an image memory 825 (see FIG. 4). After performing various image editing processes, where necessary, it forms images on recording sheets using a public-domain electrophotographic method, and ejects from the eject unit 10*b* one by one the sheets on which copies have been made.

An ADF 12 is mounted on top of the copying machine 10. This ADF 12 is a public-domain device that sends the original document, which comprises one page or multiple pages, set on the tray 14 onto the platen glass (not shown in the drawing) of the copying machine 10 one page at a time, and ejects the original document onto the tray 16 after image reading is completed.

The original document page set on the platen glass by means of the ADF 12, etc., is read for its image by means of an image reader (not shown in the drawings) built into the copying machine 10, and this image is then converted into digital data and stored in the image memory 825. The copying operation is performed by the image signal processor 820 shown in FIG. 4, which reads the image data and performs necessary editing, such as changing of the page order, image inversion or copying of both sides of the sheet, for example.

In addition, a sheet flipping mechanism 20 that flips over the sheet coming out of the copying machine 10 is located near the eject unit 10*b* of the copying machine 10. The copying machine 10 has three paths for the sheets, i.e., a first path 21 to eject the sheet from the eject unit 10*b* after flipping it over by means of the sheet flipping mechanism 20, a second path 22 to recycle the sheet inside the copying machine 10 after it is flipped over by the sheet flipping mechanism 20 so that a copy may be made on the side of the sheet opposite from the side on which a copy has already been made (two-sided copying), and a third path 23 to eject the sheet from the eject unit lOb without passing it through the sheet flipping mechanism 20. These three paths may be selectively alternated by the user.

The copying machine 10 has a function by which to perform jam correction when a paper jam occurs in the sheet conveyance path including the sheet flipping mechanism 20. In other words, when a paper jam occurs and is subsequently eliminated, the copying machine 10 performs image formation again for the original document pages for which copying has not yet properly completed, based on the image data stored in the image memory 825 in accordance with the information sent from the finisher 100. When the sheets housed in the finisher 100 have been removed by the user, jam correction is performed taking into account the sheets that have been removed. Performance of jam correction in response to the status of removal of the sheets in this way is the essence of the present invention, and the details are explained below.

Further, the copying machine 10 outputs to the finisher 100 information regarding whether or not an instruction has been issued that the ejected sheets should undergo punching or stapling based on the operation mode set by the user, and outputs either a signal that indicates that the original document has been read after being sent by the ADF 12, a signal that indicates the occurrence of a paper jam, or a signal that indicates that a paper jam has been eliminated. Based on this information, the finisher 100 performs punching or stapling, and notifies the copying machine 10 of the information necessary for jam correction, such as the information necessary to determine the number of images for which image formation should be performed again.

(3) Overall Construction of Finisher 100

Figure 2:
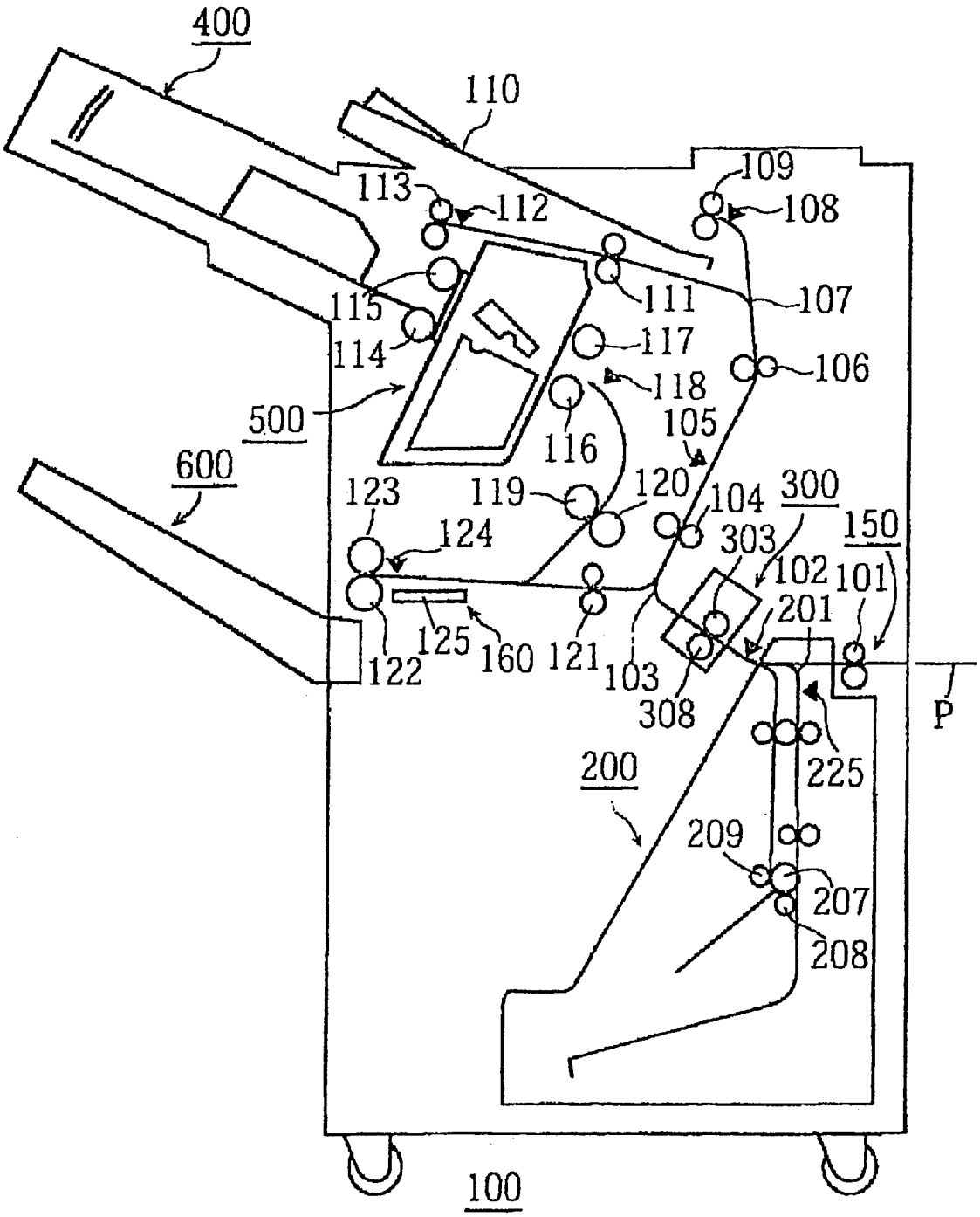
FIG. 2 is a basic cross-sectional view showing the important areas of the finisher 100 in said embodiment.

FIG. 2 is a basic cross-sectional view showing the important areas of the finisher 100 of this embodiment. The finisher 100 of this embodiment performs folding, punching and stapling selectively, or in combination where necessary, regarding the sheets P ejected and conveyed one by one from the eject unit 10*b* of the copying machine 10. In this finisher 100, assuming that it is connected to a copying machine 10 or a printer comprising an image forming apparatus of a fast page system, the form of conveyance for the sheets P, the configuration of stacking and the form of folding are determined.

As shown in FIG. 2, the finisher 100 comprises a conveyor 150 that conveys the sheets P ejected from the eject unit 10*b* into the finisher 100, a paper folder 200 that folds the sheets P conveyed one by one, a puncher 300 that punches filing holes in the sheets P conveyed one by one, a finishing tray unit 400 on which the sheets P are stacked and collated before stapling, a stapler 500 that is located downstream from the finishing tray unit 400 and staples the stacked and collated bundle of sheets, a stacking tray unit 600 that may house stapled bundles of sheets or sheets that are not stapled, and an eject tray unit 110 on which the sheets P ejected from the finisher 100 are stacked.

The conveyor 150 has a conveyor roller 101 and guide plates. The paper folder 200 has paper folding rollers 207, 208 and 209, which fold the sheet P by nipping it between them. The stapler 500 is constructed such that it can be moved both along and perpendicular to the direction of conveyance of the bundle of sheets stacked and collated on the finishing tray unit 400.

In order to convey the sheets P to various areas inside the finisher 100, sheet conveyor rollers 104, 106 and 111 are located on the conveyance path to convey the sheets one by one to the finishing tray unit 400, sheet conveyor rollers 114 and 115, 116 and 117, and 119 and 120 are located on the conveyance path to convey the bundle of sheets from the finishing tray unit 400 to the stacking tray unit 600, and a conveyor roller 12 directly conveys the sheets P to the stacking tray unit 600. Eject rollers 109 to eject the sheet P onto the eject tray unit 110, eject rollers 113 to eject the sheet P onto the finishing tray unit 400, and eject rollers 122 and 123 to eject the sheet or bundle of sheets onto the stacking tray unit 600 are located at the ends of the conveyance paths, respectively.

Multiple switching claws 201, 103 and 107 are located in the conveyance path in order to switch the destination of the sheet P. The alignment of the switching claw 201 located between the conveyor 150 and the paper folder 200 determines whether or not the sheet P is sent into the paper folder 200. A puncher 300 is located downstream from this switching claw 201, so that punching may be performed to the sheets conveyed from the conveyor 150 or from the paper folder 200. The alignment of the switching claw 103 located downstream from the puncher 300 determines whether the sheet P is conveyed towards the eject tray unit 110 or the finishing tray unit 400, or is directly conveyed toward the stacking tray unit 600. The alignment of the switching claw 107 located downstream from the switching claw 103 determines whether the sheet P is conveyed toward the eject tray unit 110 or the finishing tray unit 400.

In order to drive and stop the driving of the various components inside the finisher 100 at appropriate times, multiple sensors 102, 105, 108, 112, 118, 124 and 225 that detect the sheets P are located in the conveyance paths for the sheet or bundle of sheets.

The finisher 100 of this embodiment also has a guiding means 160 to prevent eject failure when a bundle of sheets stapled in the middle, as in the case of a weekly magazine, is ejected onto the stacking tray unit 600. The guiding means 160 shown in the drawing comprises an assisting guide plate 125 that may be moved forward and backward and that supports the bottom of the bundle of sheets ejected through the eject rollers 122 and 123.

The stacking tray unit 600 can move up or down by means of a public domain method depending on the number of sheets or bundles of sheets ejected, and moves down as the number of sheets or bundles of sheets increases.

In the finisher 100, as described above, various different finishing processes (paper folding, punching and stapling) are possible, and the user can freely select any of these processes from the operation panel of the copying machine 10.

For example, where a mode that does not involve stapling is selected by the user, the sheet P ejected from the eject unit lOb of the copying machine 10 undergoes processing by means of the paper folder 200 and puncher 300 based on the selection made by the user, and is conveyed by the rollers toward the eject tray unit 110 or stacking tray unit 600 so that it is stacked on the tray 110 or 600.

On the other hand, where a mode that involves stapling is selected by the user, the sheet P undergoes processing by means of the paper folder 200 and puncher 300 based on the selection made by the user, in the same manner as when a mode that does not involve stapling is selected. The sheet P that has been folded or hole-punched is then conveyed toward the finishing tray unit 400, where it is sequentially stacked on the previous sheets and collated. The sheets P stacked and collated are conveyed as a bundle of sheets by the rollers and sent into the stapler 500.

After the bundle of sheet is stapled in the stapler 500 at the positions desired by the user, the stapled bundle of sheets is conveyed toward the stacking tray unit 600 by the rollers and stacked on the stacking tray unit 600.

In this finisher 100, the means to process a single sheet that has been conveyed, i.e., the paper folder 200 and puncher 300, are located upstream from the first fork of the conveyance path (where the switching claw 103 is located), which leads to each stacking unit (collective term for the eject tray unit 110, finishing tray unit 400 and stacking tray unit 600). Therefore, sheets that have undergone single-paper processing (folding and punching in this embodiment) may be ejected to any of the stacking units.

Figure 3:
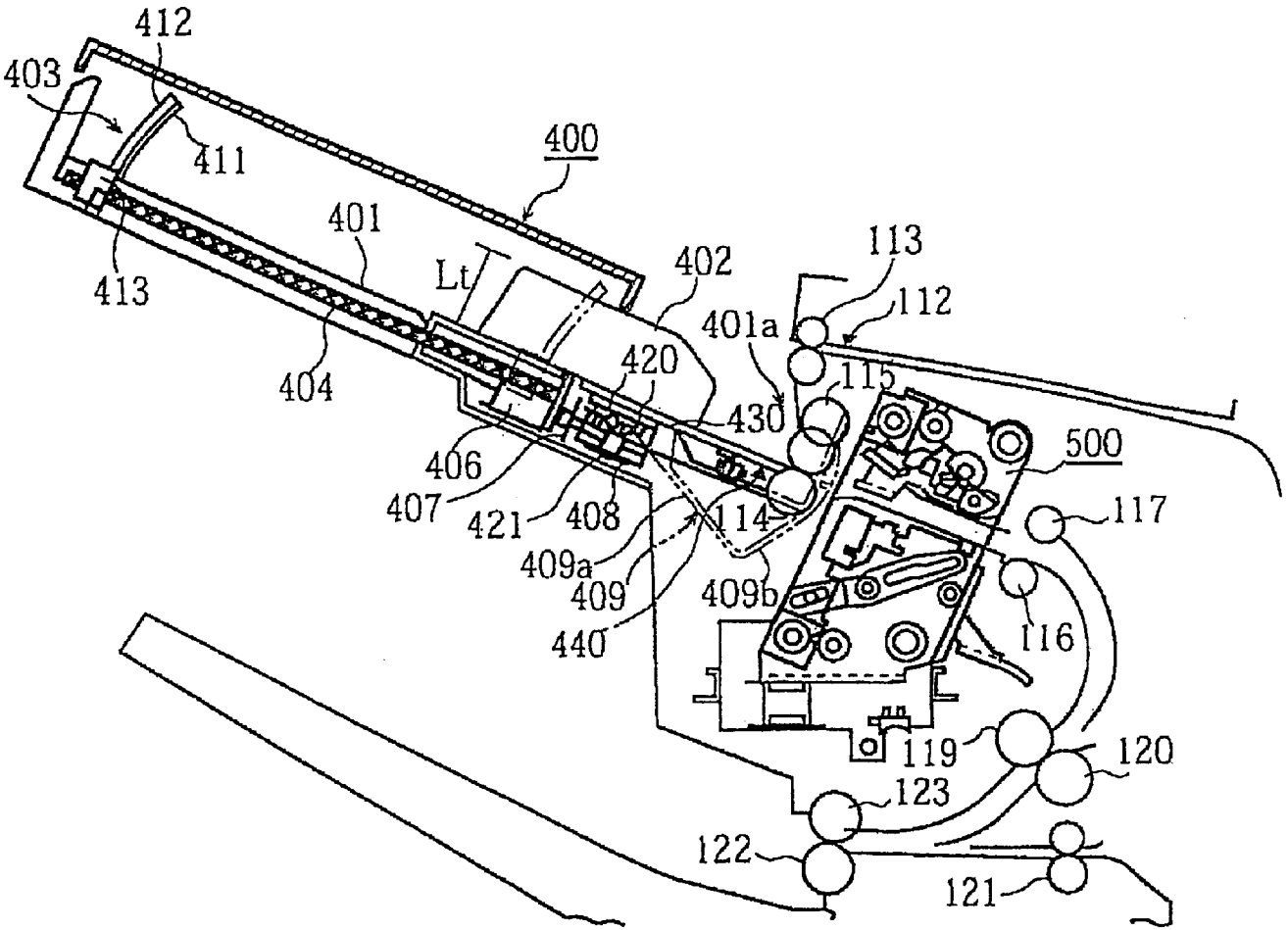
FIG. 3 is a basic cross-sectional view showing the construction of the finishing tray unit 400 and the stapling device 500 located downstream from the finishing tray.

The main mechanisms pertaining to the present invention of the finisher 100 are explained in more detail below. FIG. 3 is a basic cross-sectional view showing the construction of the finishing tray unit 400 and the stapler 500 located downstream from the finishing tray unit 400.

For purposes of this explanation, the collation along the direction of sheet conveyance when the sheets are conveyed from the finishing tray 401 to the stapler 500 (FD direction) is called 'FD collation', and the collation along the direction perpendicular to sheet conveyance (CD direction), which is the direction perpendicular to the direction of sheet conveyance when the sheets are conveyed from the finishing tray 401 to the stapler 500 is termed 'CD collation'.

The finishing tray unit 400 comprises a finishing tray 401 in which the sheet that has been flipped over upstream and is ejected by means of the eject roller 113 is temporarily housed face down, a top end stopper 409 that is located at the paper eject opening 401*a* of the finishing tray 401 and performs FD collation of the sheets, a pair of lateral collating plates 402 that perform CD collation of the sheets ejected by means of the eject roller 113, a tail end stopper 403 with which the top ends of the sheets ejected by means of the eject roller 113 come into contact so that FD collation by means of the top end stopper 409 may be performed in a stable fashion, and first bundle conveyor rollers 114 and 115 that convey to the stapler 500 a prescribed number of sheets housed in the finishing tray 401 as a bundle.

The finishing tray 401 is located such that its paper eject opening 401*a* is angled downward by a prescribed angle. A pair of lateral collating plates 402 is located such that they can move symmetrically in the CD direction, while the tail end stopper 403 is located such that it may move in the FD direction. FD collation and CD collation are performed each time a sheet is housed in the finishing tray 401. The first bundle conveyor rollers 114 and 115 comprise a bottom roller 114 and a top roller 115. The top roller 115 moves up and down so that it may press onto or move away from the bottom roller 114.

The lateral collating plates 402 comprise plate members having a width (Lt) that is larger than the maximum thickness of the bundle of sheets that may be housed in the finishing tray 401, and each collating plate is mounted to a pair of racks 420 located on the bottom of the finishing tray 401 that extend in the CD direction. The racks 420 are mounted such that they face each other and sandwich a gear 421 that is driven to rotate by a stepping motor 408. When the gear 421 rotates, the lateral collating plates 402 move symmetrically in the CD direction. Specifically, the lateral collating plates 402 move so that they come closer to each other when the stepping motor 408 rotates forward, and move away from each other when the stepping motor 408 rotates backward.

The lateral collating plates 402 have a first stand by position and a second standby position. The first standby position is a position used before the sheet is ejected by the eject roller 113. The second standby position changes depending on the size of the sheet ejected, but is set such that the distance between the lateral collating plates 402 is slightly larger than the sheet. It is a position at which the lateral collating plates 402 wait for the sheet to be ejected by the eject roller 113. The lateral collating plates 402 may freely move among the first standby position, the second standby position and the collating position at which they perform CD collation of the sheet ejected by the eject roller 113.

Multiple sensors are located on the bottom of the finishing tray 401 to detect the locations of the lateral collating plates 402. Each sensor comprises a light emitting unit and a light receiving unit that receives the light emitted from the light emitting unit. A light shielding plate that blocks the light emitted towards the light receiving unit is integrally attached to each lateral collating plate 402. The positions of the lateral collating plates 402 are detected based on the light shielding plate blocking the light emitted from the light emitting unit. In order to position the lateral collating plates 402 at a prescribed position, the number of pulses supplied to the stepping motor 408 is controlled based on the sensor detection results and the amount of rotation of the gear 421 is controlled accordingly.

The top end stopper 409 comprises a bottom plate 409*a* and a closure 409*b* that rises from the top end of the bottom plate 409*a* and has a letter 'L' configuration. It is mounted to the bottom of the finishing tray 401 such that it may rotate around the fulcrum 430 on the bottom plate 409*a*. The top end stopper 409 is pushed by means of a spring, etc., such that it is in contact with the convex area of the bottom of the finishing tray 401. The closure 409*b* of the top end stopper 409 forms the collation reference regarding the direction of sheet conveyance for the sheets housed in the finishing tray 401. By pulling back the link arm connected to the bottom plate 409*a* but not shown in the drawing by means of a solenoid, the closure 409*b* of the top end stopper 409 rotates in an arc around the fulcrum 430 and moves downward, whereby the paper eject opening 401*a* through which the bundle of sheets is conveyed to the stapler 500 is opened. The detection of this operation enables the ejection of the sheets from the finishing tray 401 to be detected.

The tail end stopper 403 comprises a plate member 412, a sponge member 411 that is glued to the side of the plate member 412 with which the sheet comes in contact, and a structure body 413 that supports the plate member 412. The top half of the plate member 412 is slightly warped toward the paper eject opening 401*a* from the right-angle position relative to the finishing tray 401.

By warping the plate member 412 of the tail end stopper 403, the following benefits are obtained. Regardless of the number, size or existence of folding of the sheets already ejected and housed in the finishing tray 401, the tail end of the sheet when the sheet is conveyed from the finishing tray 401 to the stapler 500 (the top end of the sheet when it is ejected by the eject roller 113) is in stable contact with the plate member 412 of the tail end stopper 403 at all times. Due to this contact, the sheet is moved in the direction opposite from the direction in which it is moving when it is ejected into the finishing tray 401, and as a result, the top end of the sheet when the sheet is conveyed to the stapler 500 comes in contact with the top end stopper 409, ensuring FD collation. When the sheet is folded in a 'Z' configuration (hereinafter 'Z-folded), the tail end of the sheet when it is conveyed to the stapler 500 is slightly offset from the tray bottom due to the folding. Therefore, by using the plate member 412, the top half of which is warped, the bundle of sheets, including Z-folded sheets, may be uniformly pushed so that it comes in contact with the top end stopper 409, and therefore any unevenness in collation at the top end of the sheets when the bundle of sheets, including Z-folded sheets, is conveyed to the stapler 500 may be corrected.

The structure body 413 of the tail end stopper 403 is engaged with a spiral shaft 404 located at the center of the bottom of the finishing tray 401 such that it extends in the direction of sheet conveyance. This spiral shaft 404 is connected to a drive motor 406 comprising a DC motor via a drive transmission unit comprising gears (not shown in the drawing). By driving the drive motor 406 to rotate forward or backward to rotate the spiral shaft 404, the tail end stopper 403 may be moved forward or backward in the direction of sheet conveyance to the desired degree.

A finishing tray paper detection sensor 440 is located below the finishing tray 401 and near the top end stopper 409. The existence of sheets stacked in the finishing tray unit 400 is detected by means of this finishing try paper detection sensor 440. On the other hand, the existence of sheets being housed in the finishing tray unit 400 is detected when the sheet passes the sensor 112. Because ejection of the sheets from the finishing tray unit 400 maybe detected through monitoring of the operation of the paper eject opening 401*a*, the number of sheets that should be stacked in the finishing tray unit 400 may be learned based on these detection results.

(4) Construction of Control System 900

The construction of the control system 900 in the image forming system of this embodiment is explained below. FIG. 4 is a block diagram showing the construction of the control system 900. As shown in this drawing, the control system 900 comprises a copying machine CPU 910 that controls the operation of the copying machine 10, an ADF CPU 950 that controls the operation of the ADF 12, and a finisher CPU 980 that controls the operation of the finisher 100, wherein these three components are connected. ROMs 911, 951 and 981 that store the control programs for their respective devices are connected to each CPU, as well as RAMs 912, 952 or 982 that are used as work areas.

The copying machine CPU 910 has an image memory 825 to store the image that is read and an image signal processor 820 that performs image processing such as rotation and enlargement or reduction of the image based on the image information stored in the image memory 825. This image signal processor 820 is also connected to the CCD line sensor 822 of the image reader via an A/D converter 821 that converts the analog signals read by the CCD line sensor 822 of the image reader into digital signals, and a semiconductor laser 832, which forms images, is driven based on the image signals output from the image signal processor 820 that are converted from digital to analog by a D/A converter 831. A paper supply sensor SE1 that detects that a sheet was supplied from a paper supply cassette is also connected to the copying machine CPU 910.

Various drive means such as motors and solenoids and various sensors that are located in the sheet conveyance paths in the finisher 100 and in the finishing tray unit 400 (such as the finishing tray paper detection sensor 440) are connected to the finisher CPU 980 in order to execute the operation of various components of the finisher 100.

Here, the various elements described above may be located in the image forming apparatus, the ADF or the finisher. Any of the components may be located anywhere among the three devices by enabling communication of prescribed sensor detection signals between the image forming apparatus and the finisher, for example.

There are no limitations regarding the format or contents of the information sent from the finisher 100. The information used to determine the number of images that should be re-formed may be transmitted in various forms, such as output signals from the various sensors described above, for example.

(5) Contents of Processing By Control System 900

The contents of the processing by the control system 900 are explained below. In the image forming system of this embodiment, the number of sheets that should be stacked in the finishing tray unit 400 is stored in a memory, and when a jam actually occurs and jam correction is performed after the jam is eliminated, the finishing tray paper detection sensor 440 detects whether or not sheets are stacked in the finishing tray unit 400.

Where the finishing tray paper detection sensor 440 detects that sheets are actually stacked in the finishing tray unit 400, it may be determined that the user did not remove the sheets stacked in the finishing tray unit 400 when the jam occurred. On the other hand, where no sheets are stacked in the finishing tray unit 400, it is possible that the user removed the sheets, and therefore, unless the number of pages for which image formation must be performed once more due to the jam is revised, missing pages might occur in the stapled bundle of sheets. In this embodiment, the following process is carried out to prevent the occurrence of missing pages.

Figure 5:
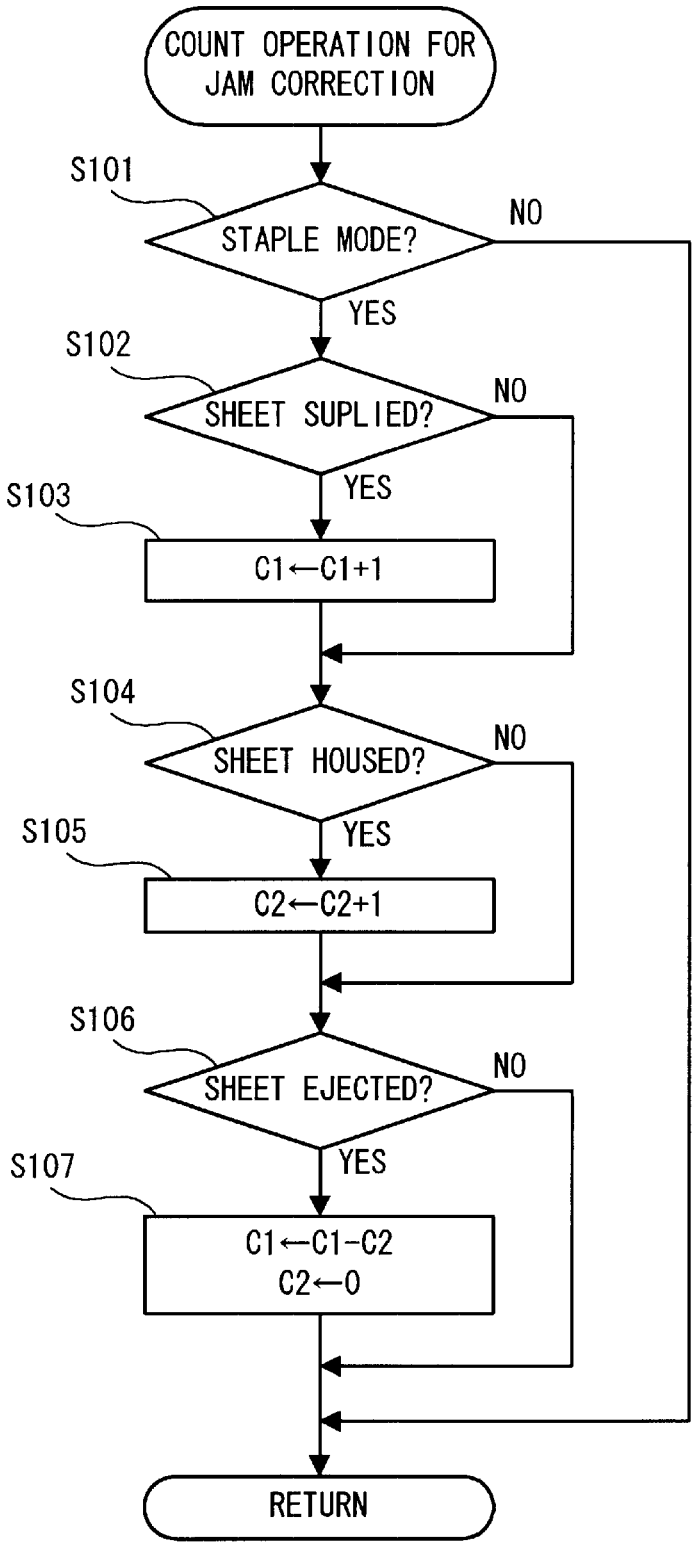
FIG. 5 is a flow chart showing the sequence of the routine executed by the finisher CPU 980 to count the number of sheets that should be being housed in the finishing tray unit 400.

FIG. 5 is a flow chart showing the sequence of the routine executed by the finisher CPU 980 to count the number of sheets that should be housed in the finishing tray unit 400.

As shown in this drawing, where stapling is instructed by the user (Yes in S101), the finisher CPU 980 increases the value of the counter C1, which is the counter to count the number of sheets supplied, by one (S103) in response to the notification from the copying machine CPU 910 that a sheet has been supplied from a paper cassette of the copying machine 10 (Yes in S102).

It is then determined from the output of the sensor 112 whether or not the sheet ejected from the copying machine 10 has been housed in the finishing tray unit 400 (S104). Where completion of housing is detected (Yes in S104), the value of the counter C2, which is the counter to count the number of sheets housed in the finishing tray unit 400, is increased by one (S105).

On the other hand, when the ejection of sheets from the finishing tray unit 400 to the stapler 500 starts, or specifically, when the paper eject opening 401*a* opens through the operation of the top end stopper 409 (Yes in S106), the value of the counter C1 is subtracted from the value of the counter C2 and the value of the counter C2 is cleared (S107). Through this routine, the number of sheets that have been supplied by the copying machine 10 but are not yet stacked in the finishing tray unit 400 may be detected.

Figure 6:
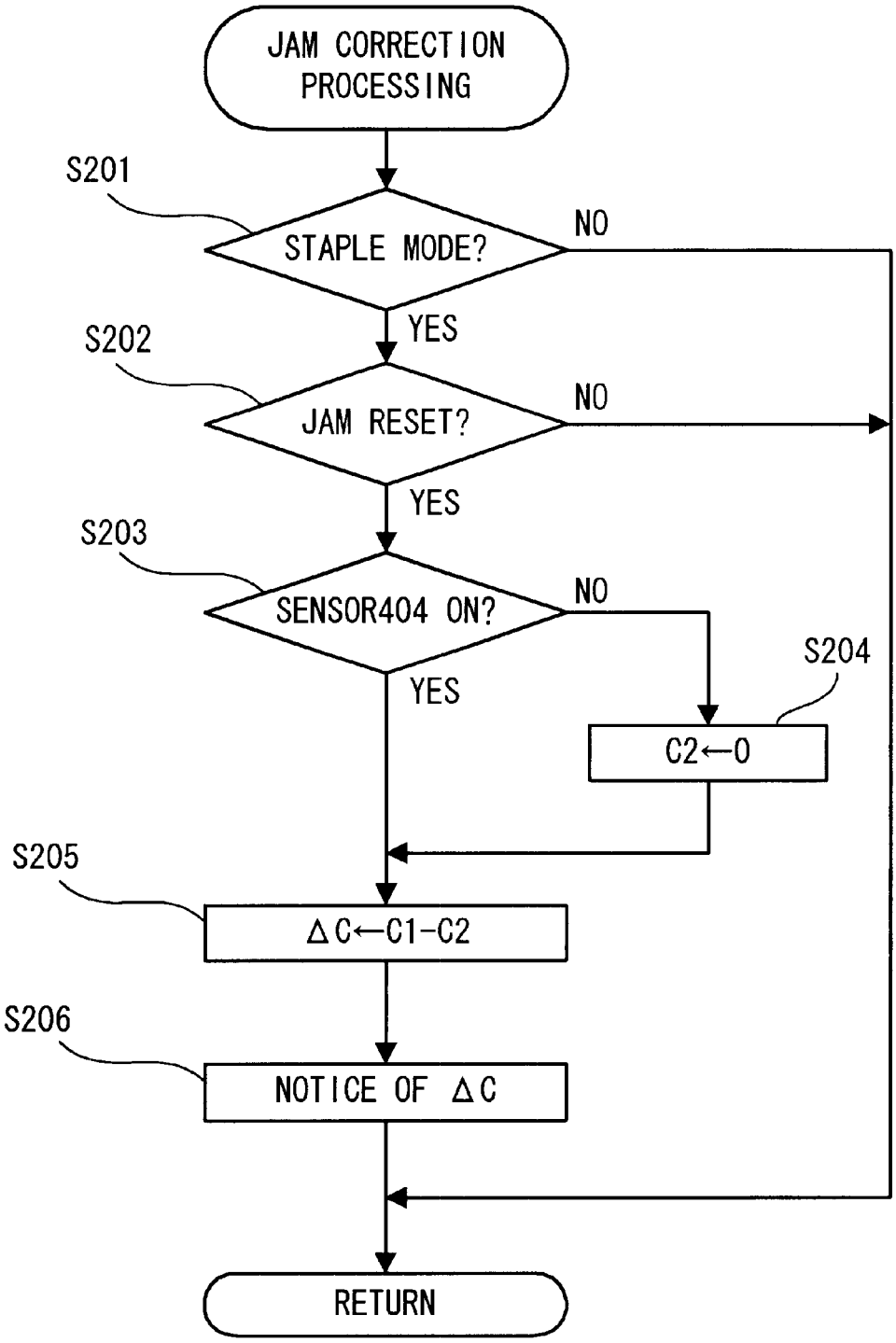
FIG. 6 is a flow chart showing the sequence of the routine executed by the finisher CPU 980 to perform jam correction.

The contents of the processing by the finisher CPU 980 for jam correction when a jam occurs in the copying machine 10 are explained below. FIG. 6 is a flow chart showing the sequence of the jam correction routine executed by the finisher CPU 980.

As shown in this drawing, in the jam correction routine, when stapling is instructed by the user (Yes in S201) and jam reset, which is carried out when a jam occurs, is to be performed in the copying machine 10 (Yes in S202), it is determined whether or not the output from the finishing tray paper detection sensor 440 is ON (S203).

Where the output from the finishing tray paper detection sensor 440 is ON (Yes inS 203), it means that the user has not removed the sheets stacked in the finishing tray unit 400, and therefore, the value of the counter C2 is subtracted from the value of the counter C1 to calculate the difference ΔC so that regular jam correction will be performed (S205). Because this difference AC indicates the number of sheets for which copying was not properly completed due to the occurrence of a jam, the copying machine CPU 910 is notified so that it will perform image formation for the number of pages represented by the difference ΔC (S206) . The copying machine 10 may perform regular jam correction based on the value of the difference ΔC thus sent to it.

On the other hand, where the output from the finishing tray paper detection sensor 440 is OFF in step S203 (No in S203), that indicates that the user may have removed the sheets from the finishing tray unit 400 when the jam occurred, such that if regular jam correction were performed, missing pages could occur after stapling. Therefore, the finisher CPU 980 clears the value of the counter C2 (S204), calculates the difference ΔC (S205) and sends the calculated result to the copying machine CPU 910 (S206).

Through the processes described above, the copying machine CPU 910 can perform accurate jam correction taking into account the sheets removed by the user from the finishing tray unit 400, and therefore, missing pages after stapling maybe prevented. There are cases in which the output from the finishing tray paper detection sensor 440 could be off even if the user has not removed the sheets from the finishing tray unit 400 after the occurrence of a jam, but since this is a case in which the value of the counter C2 should be zero in any event, there are no problems if step S204 is taken.

As explained above, using the image forming system of this embodiment, when a jam occurs in the image forming apparatus, even if the user removes the sheet from the sheet stacking means in the finisher when eliminating the jam, no missing pages occur in the results of the image formation.

In this embodiment, an explanation was provided regarding the case in which the present invention is applied in an image forming system comprising a copying machine 10 and a finisher 100, but the image forming apparatus is not limited to a copy machine. Naturally, the present invention may be applied in cases where a regular printer is used.

In other words, where sheets on which images have been formed by the printer based on the image data sent from an information processor, for example, are stacked in the stacking means in the finisher, the value of the difference AC is sent to the printer. Where image data is stored in the memory of the printer, images should be formed once more using this image data. It is also acceptable if notification is sent to the information processor that sent the image data to the printer. If the information processor that has been notified re-sends the image data for the pages corresponding to the difference ΔC, missing pages after image formation can be prevented in the same way as when the copying machine 10 is used.

In addition, in the embodiment described above, an explanation was provided regarding the case in which jam correction is performed for a jam that occurs in the recording sheet conveyance system of a so-called digital copying machine, which stores in an image memory the image data from the original document conveyed by means of the ADF 12, and then performs image formation using the stored image data, but the present invention can also be applied when jam correction is performed for a jam that occurs in the original document conveyance system of the ADF.

In this case, the number of pages of the original document conveyed by the ADF 12 and read should be counted by means of the counter C1. By doing so, the number of sheets that were conveyed by the ADF 12 and read but for which image formation has not been performed and which have not been housed in the finishing tray unit 400 may be learned. Consequently, when a jam in the AFD 12 is eliminated, missing pages after image formation may be prevented by calculating the value of the difference ΔC in the same manner as in the embodiment described above and sending this value to the ADF CPU 950 via the copying machine CPU 910 so that the original document will be read and image formation performed once more.

Performing these processes is particularly effective in the case of an analog copying machine in which an ADF is mounted. When a jam in the ADF is eliminated, jam correction is often performed in the following way: a message is displayed on the display unit of the operation panel asking the user to place the original document in the same location as at the start of the copying operation and press the print button, for example, and when the user presses the print button, the original document pages that have already been properly read are skipped by means of the ADF and reading is performed regarding the original document pages that have yet not been properly read. This is required because in the case of an analog copying machine, since an image memory is not used in the image formation process, the original document pages that have already been read need to be read once more in order to replace the sheets removed from the finishing tray.

Further, in the embodiment described above, a detailed explanation was provided regarding a finisher in which the sheets stacked in the finishing tray 401 are ejected from the paper eject opening 401*a* toward the stapler 500, but the application of the present invention is not limited to this type of finisher. The present invention may also applied in a finisher that performs stapling with sheets ejected into a so-called bin. Specifically, if a jam occurs before stapling when the recording sheets have been ejected into a bin and the jam is eliminated, the existence of the recording sheets is detected by a sheet detection sensor located near the bin. Where there are no recording sheets in the bin even though they should have been ejected to the bin, jam correction should be performed taking into account the number of recording sheets that should exist in the bin.

The explanation of the above embodiment involved the situation in which images are formed on sheets of paper, which are one example of a recording sheet, but the recording sheets are not limited to paper. Needless to say, the present invention may be applied to all types of recording sheets on which images may be formed, including OHP transparencies.

In the embodiment described above, a tray used to perform stapling was shown as the finishing tray, but the finishing process and finishing tray in the present invention are not limited to this example. For example, the present invention may be applied to a finisher in which the sheets that have undergone image formation are stacked on a finishing tray and the sheets bundled on the tray are folded, for example. The same is true regarding the punching process. For example, the present invention may be applied to a finisher that punches holes in a bundle of sheets after a designated number of sheets have been printed.

As described above, using the image forming system of the present invention, when a paper jam is eliminated, before the number of images that should be formed again is calculated by subtracting the count value of the second counting means that counts the number of recording sheets stacked on the stacking means from the count value of the first counting means that counts the number of pages of the original images for which images should be formed by the image forming apparatus, it is determined whether recording sheets are stacked on the stacking means, and where it is determined no recording sheets are stacked there, the count value of the second counting means is set to zero, so that the calculation described above maybe made using this zero value. Therefore, when a jam occurs in the image forming apparatus and the user removes the sheets from the stacking means in the finisher when eliminating the jam, the occurrence of missing pages after image formation may be prevented.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

an image forming unit for receiving a job comprising multiple pages and sequentially performing image formation;

a tray for receiving sheets on which images have been formed by the image forming unit;

a counter for counting the number of sheets received by the tray;

a first controller that, when a jam occurs in the image forming unit during the job and image formation is subsequently restarted, if sheets are remaining on the tray, restarts image formation with the page corresponding to the count value of the counter; and a second controller that, when a jam occurs in the image forming unit during the job and image formation is subsequently restarted, if sheets are not remaining on the tray, restarts image formation with the first page regardless of the count value.

2. An image forming apparatus comprising:

a sheet supplying unit for supplying sheets;

an image forming unit for forming images on the supplied sheets by performing multiple image forming operations;

a first counter for counting a number of the sheets supplied from the sheet supplying unit to the image forming unit;

a holder for holding the sheets ejected from the image forming unit;

a finisher for performing finishing processes to the sheets ejected from the holder;

a second counter for counting the number of the sheets held on the holder;

a first sensor for detecting whether or not the sheets are stacked on the holder; and a controller for controlling the image forming unit so that where the first sensor detects that sheets are stacked on the holder after a paper jam that occurred in the image forming unit is eliminated, the image forming unit restarts image formation based on the number of sheets counted by the first counter and the number of sheets counted by the second counter, and where the first sensor detects that no sheets are stacked on the holder after a paper jam that occurred in the image forming unit is eliminated, the image forming unit restarts image formation based on the number of sheets counted by the first counter regardless of the number of sheets counted by the second counter.

3. The image forming apparatus according to claim 2, wherein the controller comprises a calculation controller that, where the sensor detects that no sheets are stacked on the holder, resets the count value of the second counter, and a calculator that calculates the number of images for which image formation should be re-performed by subtracting the count value of the second counter from the count value of the first counter, thereby the controller controls the image forming unit so that the image forming unit restarts image formation for the calculated number of images.

4. The image forming apparatus according to claim 2, wherein the finishing process is attained by a process in which multiple sheets are stapled together.

5. The image forming apparatus according to claim 2, further comprising:

a second sensor for detecting the ejection of the sheets from the holder; and a counter controller that, in response to the detection by the second sensor, subtracts the count value of the second counter from the count value of the first counter and sets the difference as the count value of the first counter, and resets the count value of the second counter.

6. An image forming system comprising an image forming apparatus having a function in which, when a paper jam occurs in an original document conveyance system or in a recording sheet conveyance system and is subsequently eliminated, the images that were not properly formed due to the problem are formed again, and a finisher that has a tray on which the recording sheets ejected from the image forming apparatus are stacked and for performing a finishing process to the recording sheets, said system comprising:

a first counter for counting the number of the original document pages on which an image should be formed by means of the image forming apparatus;

a second counter for counting the number of recording sheets stacked on the tray;

a calculator that, when a paper jam is eliminated, calculates the number of images that should be formed again by subtracting the count value of the second counter from the count value of the first counter;

a determining unit for determining whether or not recording sheets are stacked on the tray before the calculation by means of the calculator takes place; and a controller that, where it is determined by the determining unit that no recording sheets are stacked on the tray, sets the count value of the second counter to zero and prompts the calculation by the calculator.

7. The image forming system according to claim 6, wherein the finisher has an ejection mechanism to eject the recording sheets stacked on the tray toward the position at which the finishing mechanism is located; and the first counter and the second counter subtract the number of recording sheets ejected by the ejection mechanism from their own count value when recording sheets are ejected by the ejection mechanism.

8. The image forming system according to claim 6, wherein the image forming apparatus is attained by a copying machine that stores the image data read from the original document in a memory and forms images based on the image data thus stored, and has a function by which, when a paper jam occurs, image formation is re-performed based on the image data stored in the memory for the number of pages calculated by the calculator.

9. The image forming system according to claim 6, wherein the image forming apparatus sequentially reads the pages of the original document stacked on the original document automatic feeder to make copies, and has a function by which, when a paper jam occurs in the original document conveyance system, the original document is read again for the number of pages calculated by the calculator and image formation is re-performed for the original document pages thus read again by stacking the original document in the same manner as at the commencement of the copying operations and instructing the performance of another set of operations.

10. A finisher comprising:

a tray on which the recording sheets ejected from an image forming apparatus are stacked;

a first sensor that detects the stacking of a recording sheet on the tray and generates a signal representing the number of sheets on the tray; and a second sensor that, when a paper jam occurs in a original document conveyance system or in a recording sheet conveyance system of the image forming apparatus and is subsequently eliminated, detects whether or not recording sheets are stacked on the tray, and generates a signal representing the detection result.

11. An image forming method comprising:

a step in which multiple images are sequentially formed by the image forming apparatus on multiple sheets, which are then ejected outside the apparatus;

a step in which the sheets ejected from the image forming apparatus are sequentially held on the first holder;

a step in which a finishing process is performed to the sheets held on the first holder;

a step in which, when a paper jam occurs in the image forming apparatus, it is determined whether or not the sheets are stacked on the first holder;

a step in which, when the paper jam is eliminated, the first image of the images to be sequentially formed is determined based on the sensor output; and a step in which image formation is performed again in response to the determination.

* * * * *